US006266959B1

(12) United States Patent
Markwart

(10) Patent No.: US 6,266,959 B1
(45) Date of Patent: Jul. 31, 2001

(54) DEVICE FOR SAVING ENERGY

(75) Inventor: Jurgen Markwart, Nersingen (DE)

(73) Assignee: Hydac Technology GmbH, Sulzbach (DE)

( * ) Notice: Subject to any disclaimer, the term of this patent is extended or adjusted under 35 U.S.C. 154(b) by 0 days.

(21) Appl. No.: 09/155,484

(22) PCT Filed: Mar. 29, 1997

(86) PCT No.: PCT/EP97/01613

§ 371 Date: Sep. 29, 1998

§ 102(e) Date: Sep. 29, 1998

(87) PCT Pub. No.: WO97/42417

PCT Pub. Date: Nov. 13, 1997

(30) Foreign Application Priority Data

May 4, 1996 (DE) ..... 196 17 950

(51) Int. Cl.[7] ..... F15B 1/24
(52) U.S. Cl. ..... 60/414; 60/415
(58) Field of Search ..... 60/413, 414, 415; 91/4 R

(56) References Cited

U.S. PATENT DOCUMENTS

| | | | | |
|---|---|---|---|---|
| 2,286,798 | * | 6/1942 | Flowers | 60/713 X |
| 2,505,771 | * | 5/1950 | Hoar et al. | 91/209 |
| 2,721,446 | | 10/1955 | Bumb | 60/415 |
| 2,937,663 | * | 5/1960 | Ashton et al. | 91/209 |
| 2,984,980 | * | 5/1961 | Rowles et al. | 60/417 |
| 3,018,627 | | 1/1962 | Perricci | 60/415 X |
| 3,336,948 | * | 8/1967 | Lucien | 138/31 |
| 3,987,708 | * | 10/1976 | Uhrich | 60/413 X |
| 4,667,473 | * | 5/1987 | Robinson | 60/415 |
| 5,165,232 | * | 11/1992 | Amelio et al. | 60/416 |
| 5,797,583 | * | 8/1998 | Murata et al. | 60/415 X |

FOREIGN PATENT DOCUMENTS

| | | | | |
|---|---|---|---|---|
| 3139600 | | 4/1983 | (DE) . | |
| 4438899 | | 9/1995 | (DE) . | |
| 1017834 | * | 5/1983 | (RU) | 60/415 |

* cited by examiner

*Primary Examiner*—John E. Ryznic
(74) *Attorney, Agent, or Firm*—Roylance,Abrams,Berdo & Goodman, L.L.P.

(57) ABSTRACT

A device to save energy for hydraulically-operated tool shanks uses a piston-type accumulator having a housing in which at least two longitudinally displaceable pistons are arranged and are connected to by a coupling part. The coupling part is guided to be longitudinally displaceable in a partition wall of the housing which bounds two fluid chambers with the two pistons. At least one of the pistons bounds at least partially, a fluid chamber and a pre-loaded chamber with presettable internal gas pressure on the opposite sides. A wider range of possible applications is achieved for hydraulically-operated tool shanks using this energy saving device.

9 Claims, 3 Drawing Sheets

DEVICE FOR SAVING ENERGY

FIELD OF THE INVENTION

Figure 1:
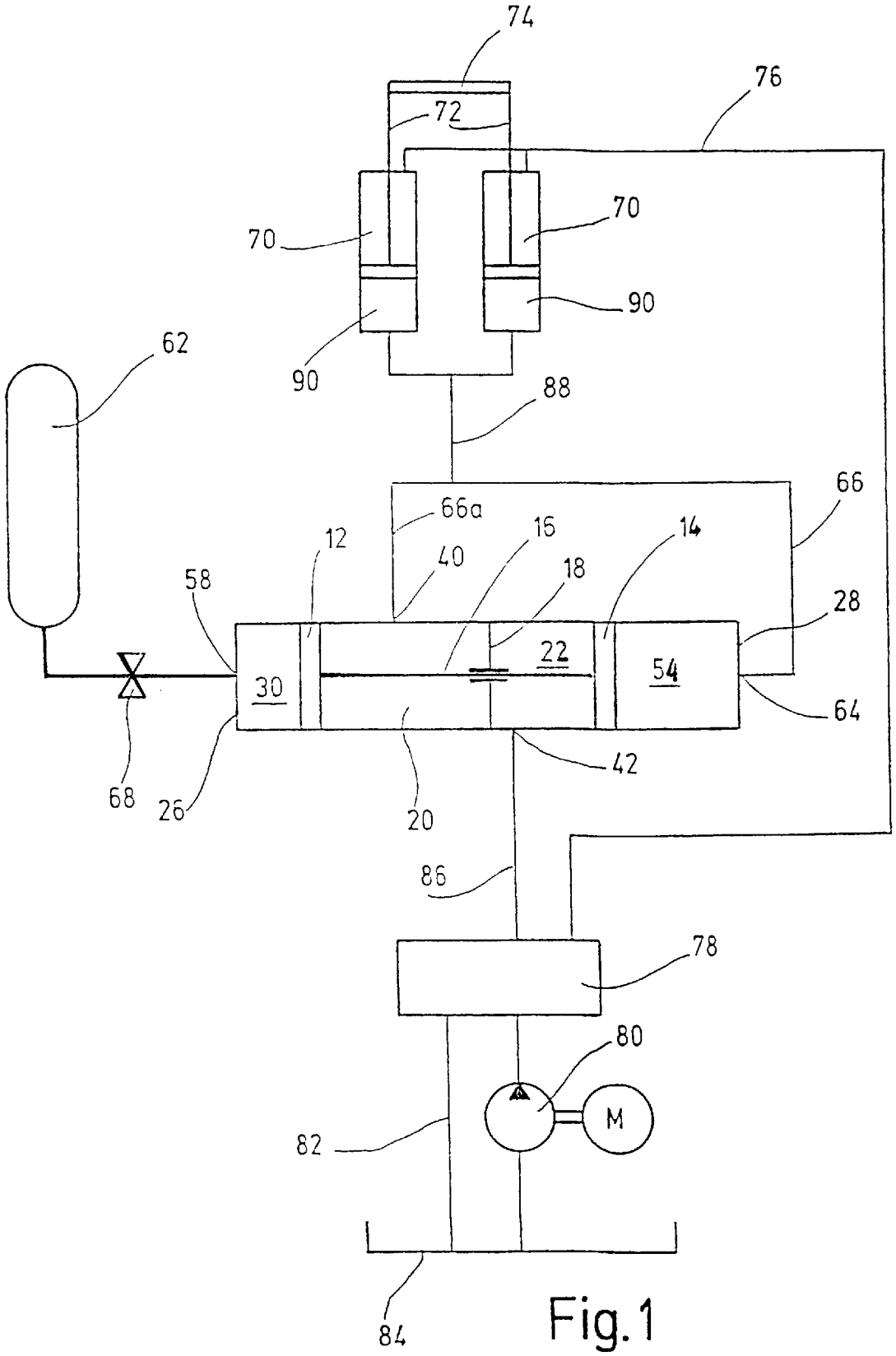

The present invention relates to a device for saving energy, while using hydraulically operated active working assemblies or tool shanks having a piston accumulator.

BACKGROUND OF THE INVENTION

Such energy-saving and energy -recovery devices, as disclosed in PCT/WO 93/11363 and DE 44 38 899 C1, use traditional hydraulic-pneumatic accumulators as energy reservoirs. In the energy recovery device disclosed in the PCT specification, the piston chamber of a hydraulically operable working cylinder is connected with the hydraulic accumulator through a cartridge valve. The cartridge valve cooperates with a control manifold connected to a pressure relay as part of a fluid control system. This fluid control system arrangement is in turn connected at its control input to a low-pressure branch of the hydraulic circuit, which cooperates with the displaceable parts of the working machinery in the form of active working assemblies or the like. With lowering of the active working assembly or the like, the fluid volume on the piston side of the working cylinder is integrated with the relevant available potential energy. The fluid is then discharged under pressure to the hydraulic reservoir/accumulator, and can be recycled from there precisely quantifiably for the subsequent lifting or raising process concerning the active working assembly to recover the energy introduced into the hydraulic accumulator. A good energy recovery ratio is attained with this arrangement, insofar as three or more working cylinders are used as hydraulically working active working assemblies. For all practical purposes three or more working cylinders are not used, especially with hydraulically operable machinery such as steam shovels or excavators or the like. Also, while holding the active working assemblies, the cartridge valves are inclined to be lowered under the effect of the load until they oscillate or flutter. The oscillating or fluttering leads to an undesired rocking of the active working assembly arrangement, usually in the form of a steam shovel, excavator or crane jib.

In DE 44 38 899 C1 such cartridge valves are abandoned in favor of hydraulic lockable check valves in a connecting conduit extending between the hydraulic accumulator and the hydraulic machinery to be operated. This arrangement is also of reasonable cost and functionally reliable. However, it has been shown in practice that with hydraulic operable working cylinders, upon discharge of the recovered energy with the associated volume of fluid, these cylinders are strongly influenced in a negative sense, which can lead to stoppages in the train of movement.

An operating device for a hydraulically operable working cylinder is disclosed in U.S. Pat. No. 2,721,446. Continuous operation maintenance for hydraulically operated cylinder is obtained through a hydraulic pump protected by a check valve. When interference and interruption occur in the sense of need for emergency/temporary supply, the piston accumulator using two longitudinally displaced pistons and working through the preloaded internal gas pressure in the preloaded chamber secures further hydraulic supply for the working cylinder and causes displacement of the same. The ambient atmosphere chamber of the known piston accumulator arranged at the opposite end of the preloaded chamber extends through a ventilation opening into the ambient atmosphere. A supply line is guided in the branch between the piston accumulator and the working cylinder, protected by means of the check valve in relation to the hydraulic pump, and allows for the resulting emergency/temporary supply to the working cylinder. The supply line does not allow for an erroneous hydraulic connection, such as would be possible with this known device, for a continuous energy savings during operation of the working cylinder. Thus, an undesirable temperature rise caused by compression in the air-filled ambient atmosphere chamber results and the fluid volumes to be controlled for emergency/temporary operation turn out to be correspondingly large, which is unfavorable from the point of view of savings of energy.

SUMMARY OF THE INVENTION

Objects of the present invention are to provide a device for energy savings in hydraulically operable active working assemblies, with expanded range of use, which does not include the aforementioned drawbacks.

The foregoing objects are basically obtained by a device for saving energy, comprising a hydraulically operable working assembly, a hydraulic pump and a piston accumulator. The piston accumulator includes a housing in which first and second longitudinally displaceable pistons are arranged and are connected facing one another by a coupling part. The coupling part is guided for longitudinal displacement in a partition wall of the housing. The housing and the pistons define first and second fluid chambers therebetween. The first piston at least partially limits a preloaded chamber with a predeterminable internal gas pressure on one side of the first piston, with the first fluid chamber being on an opposite side of said first piston. The first fluid chamber is being provided with a filter medium and is connected to said working assembly. The second piston at least partially limits an ambient atmosphere chamber of the piston accumulator. The ambient atmosphere chamber is connected in fluid communication to the working assembly and to the first fluid chamber. A reversible fluid control unit connects the second fluid chamber to the hydraulic pump.

By forming the device in this manner, the forcefully coupled pistons of the piston accumulator can be moved so as to cause the preloaded chamber to become smaller and to allow an increase of the internal gas pressure. The internal gas pressure decreases, in the sense of the release of tension, as soon as the pistons are moved in the other direction with a resulting increase of the volume in the preloaded chamber. The volume of gas enclosed in the preloaded chamber then forms a sort of force accumulator comparable to a mechanical spring. The movement energy introduced by the displacement movement in the accumulator can be recaptured by suitable operation of the reversible fluid control unit. Since the ambient atmosphere chamber of the piston accumulator additionally is fluid-carrying, undesirable heating occurring as a result of compression processes is thus avoided, and the required fluid volumes to be controlled for execution of a lifting process can be minimized, which is favorable in terms of saving energy.

Piston accumulators being used in the energy saving device belong to the family of hydraulic accumulators to which also belong bubble accumulators and diaphragm/membrane accumulators or reservoirs. One of the main purposes of these hydraulic accumulators, dependent upon the volumes of compressed fluid of a hydraulic system, is to receive and to feed this back, needed, into the system. The known piston accumulators thus include a liquid part and a gas part with a piston serving as gas-tight partition element, in which the gas side is filled with nitrogen. The liquid side of the piston accumulator remains in connection with the hydraulic circuit, so that with a rise of the pressure in the piston accumulator more liquid is received, and the gas is compressed on the gas side. With dropping pressure the compressed gas expands and thereby forces the stored compressed liquid into the hydraulic circuit. Piston accumulators can then basically be used at any site where a perpendicular arrangement is preferred with the gas side upward, so that deposition of contaminants out of the liquid onto the piston gaskets is avoided. As opposed to the diaphragm/membrane and bubble accumulators, the piston accumulator has no flexible partition element in the form of a rubber diaphragm or rubber bubble, but rather has a rigid piston, which hardly undergoes any wear and as with the device according to the present invention can work without breakdown even over very long time periods.

With use of the piston accumulator according to the present invention, as part of the energy saving device, it has been shown that in terms of energy and for saving of energy, it is especially favorable to associate a high internal gas pressure in the preloaded chamber with a middle piston or arm setting of the hydraulically operable active working assembly. The working assembly is slackened out of this middle position with discharge of energy, insofar as the arms is to be raised while under load. The energy saving device need not be limited to machinery, but rather can likewise be used in hydraulic braking assemblies, in cabin elevators and also with hydraulic engines or the like. In these cases, for the production of a small force constant or elasticity constant, it is a good idea to provide a large volume in the preloaded chamber. To attain this, an arrangement can be provided to connect the preloaded chamber to another gas supply arrangement, especially in the form of a nitrogen reservoir serving as a cushion.

Other objects, advantages and salient features of the present invention will become apparent from the following detailed description, which, taken in conjunction with the annexed drawings, disclose preferred embodiments of the present invention.

BRIEF DESCRIPTIONS OF THE DRAWINGS

Figure 2:
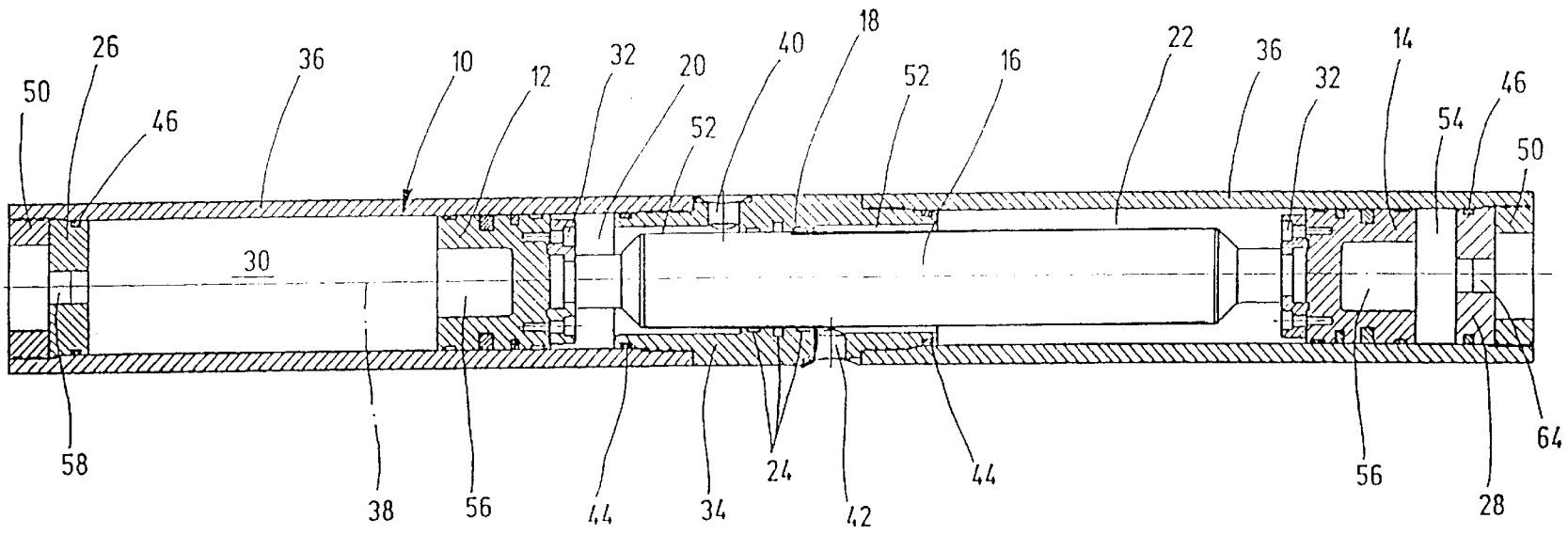
Figure 3:
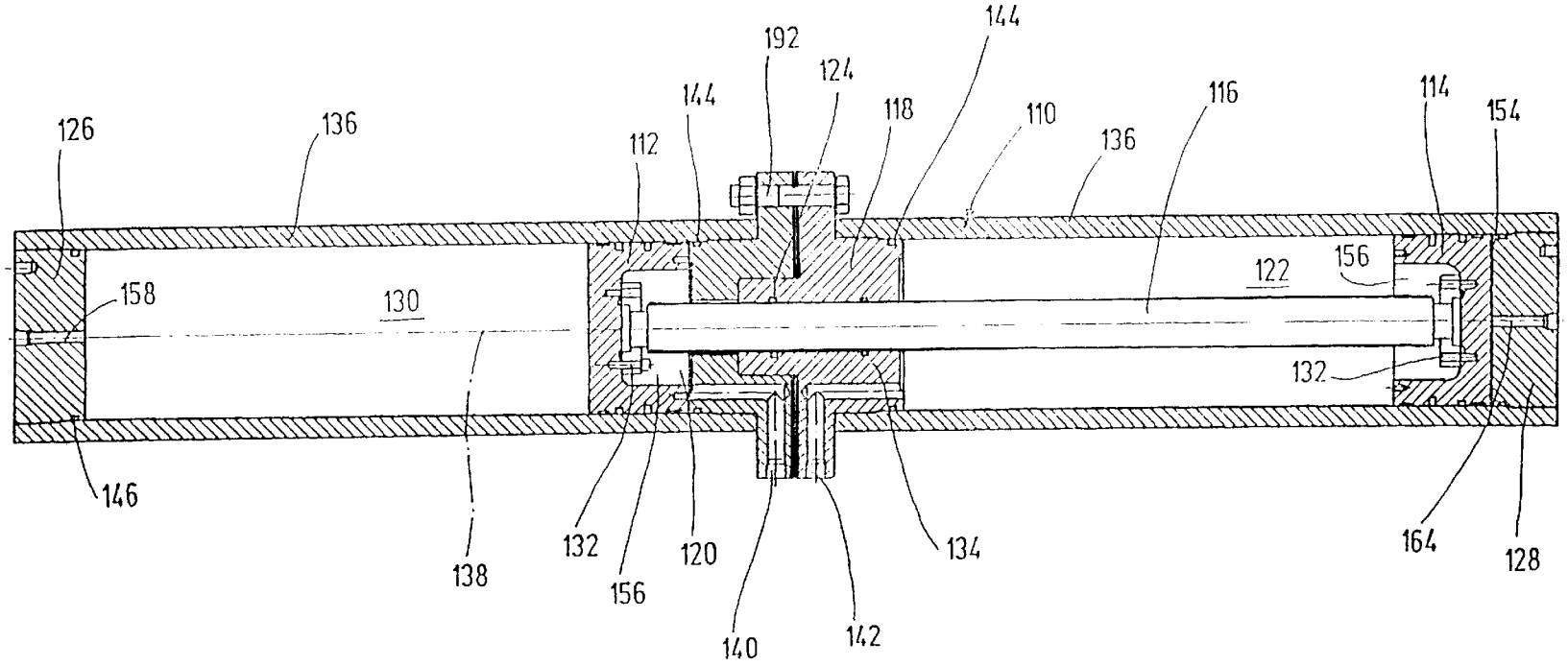

Referring to the drawings which form a part of this disclosure:

FIG. 1 is a schematic diagram showing the use of a piston accumulator in an energy saving arrangement for hydraulically operable active working assemblies or the like in the form of working cylinders according to the present invention;

FIG. 2 a side elevational view in a section of a first embodiment of the piston accumulator as shown in FIG. 1; and FIG. 3 is a side elevational view in a section of a second embodiment of a piston accumulator which can be used in the circuit of FIG. 1.

DETAILED DESCRIPTION OF THE INVENTION

The piston accumulator shown in FIG. 2 has a housing, indicated in its entirety as 10. Housing 10 is in the form of a cylindrical tube, but can also be configured of other cross sections (quadratic, elliptical). In housing 10, two longitudinally displaceable pistons 12 and 14 are arranged and are connected with one another through a coupling part in the form of a solidly constructed coupling rod 16. Coupling rod 16 is longitudinally displaceably guided on a partition wall 18 of housing 10. Partition wall 18 is formed in the cylindrical middle segment of housing 10 and which, with two adjacent facing pistons 12 and 14, defines two fluid chambers 20 and 22. To seal off the two fluid chambers 20 and 22 from one another, the surrounding partition wall 18 incorporates corresponding round sealing gaskets 24. Housing 10 is limited on the ends by two sealing walls 26 and 28, which from the closing cover over the piston accumulator. Between left sealing wall 26 shown all the way to the left in FIG. 2 and the adjacent facing piston 12, a preloaded chamber 30 is located. Chamber 30 is limited by these parts, and is set with the presettable internal gas pressure therein.

Fluid chambers 20 and 22 expand in diameter from partition wall 18 to the respective pistons 12 and 14 about a stage in which the coupling is constructed between pistons 12 and 14. When one fluid chamber 20 has a small volume, the other fluid chamber 22 is proportionally enlarged to contain a correspondingly greater volume. Coupling rod 16 is configured to be solid, and is in tight contact or fixed engagement at the ends by means of screws 32 on the walls the respective pistons 12 and 14. Pistons 12 and 14, in conventional configuration, have exterior, suitably shaped, sliding gasket rings around their peripheries. Partition wall 18 is part of a tubular central support 34. The ends of the central support are attached to the housing tube parts 36 of housing 10, which serve for the longitudinal guiding of pistons 12 and 14. In a radial or transverse direction relative to the longitudinal axis 38 and diametrically opposite and facing one another as well as limited by partition wall 18, two connector plugs 40 and 42 extend through central support 34, and open into the associated fluid chamber 20 or 22. The H-shaped central support, as seen in FIG. 1, has a transverse section in the alignment of longitudinal axis 38, and is inserted in turn in a sealed manner at both ends by gasket rings 44 into the two housing tubes 36 and fluid chambers 20 and 22, sealed off from the surrounding atmosphere. Likewise, each of the two sealing walls 26 and 28 has a gasket ring 46 on the exterior periphery.

Sealing sheathings 50 serve for the setting of the sealing walls 26 and 28. The sheathings, in turn are screwed into the free ends of the two housing tubes 36 to securely hold the sealing walls 26 and 28 in their positions shown in FIG. 2. The respective connector plugs 40 and 42 open in turn in a cylindrical transverse passage 52, with the coupling rod 16 passing therethrough, whatever the setting of pistons 12 and 14. Passages 52 extend parallel to longitudinal axis 38 of the piston accumulator. For receiving screws 32, as well as to adapt to the enlargement of preloaded chamber 30 and an opposing ambient atmosphere chamber 54, each of the two pistons 12 and 14 has a hollow cylindrical middle cutout 56.

Stationary sealing wall 26 of housing 10, limiting the outside limits of the preloaded chamber 30, has a connector plug 58, which can be sealed off by a sealing plug (now shown). Following removal of the closing and sealing plug, the preloaded chamber 30 can be connected through the connector 58 to a gas supply device (cf. FIG. 1), especially in the form of a nitrogen reservoir 62. The ambient atmosphere chamber 54, which is limited by the other sealing wall 28 as well as by piston 14, can be connected through a passage 64 to a supply line 66. Housing 10, with its two housing tubes 36, defines and limits fluid chambers 20 and 22 around their exterior peripheries.

Preloaded chamber 30 is filled with a working gas, usually in the form of nitrogen, and is allowed a certain interior gas pressure. For the filling of preloaded chamber 30, the closing plug need not be described in any more detail, and can be provided with a valve device 68 (FIG. 1). Valve device 68 allows gas passage in the direction of preloaded chamber 30, but acting in the sense of a check valve blocks gas discharge. The gas in preloaded chamber 30 with presettable interior gas pressure consequently forms a gas or pressure cushion with a predetermined spring rigidity or elasticity constant, insofar as comparison to a mechanical model is made. The pressure cushion in this case, as compared with the mechanical model, forms a sort compression of pressure spring. If the two pistons 12 and 14 are displaced to their furthermost right positions in FIG. 2, piston 12 impacts on the facing end of the central support 34 and piston 14 contacts sealing wall 28. Since ambient atmosphere chamber 54 is attached to supply line 66, the fluid volume being stored in ambient atmosphere chamber 54 is forced out into supply line 66. In the end setting which is reached in this moment, the preloaded chamber 30 then takes on its greatest volume as does also fluid chamber 22, which can be filled with fluid through connector plug 42. Fluid chamber 20, preferably filled with air, and connector plug 40 which opens into the surrounding atmosphere, then takes in its smallest volume and the interior gas pressure in preloaded chamber 30 is diminished by the volume expansion taking place in preloaded chamber 30, which is comparable in the mechanical model with slackening of the pressure spring.

In the reverse direction of movement, the volumes of preloaded chamber 30 as well as fluid chamber 22 decrease, and fluid chamber 20, increases to its maximum possible volume. The gas in preloaded chamber 30 is correspondingly compressed and initially preloaded, so that it equals the tension of a mechanical spring. The gas or spring energy thus generated can then mandate the reaction, which is to be more clearly explained hereinafter, to assist in the operation of a hydraulic active working assembly or the like. In additional to the shown two-piston arrangement, still more pistons (not shown) can be used if necessary for further control procedures, which if necessary also increases the number of fluid chambers as well as preloaded chambers and other gas chambers. Also a plurality of piston accumulators could be connected in series either one after the other or in parallel.

FIG. 1 shows the use of the piston accumulator of FIG. 2 with a device for energy saving using a hydraulically operable active working assembly in the form of two hydraulic cylinders 70. The two hydraulic cylinders 70 are working simultaneously in connection with one extended arm 74, for example in the form of a crane or steam shovel or excavator arm, by means of their piston rods 72. Arm 74 can also represent a lifting platform such as is used with freight elevators and personnel elevators as well as elevating platforms, insofar as these assemblies are displaceable by means of hydraulic cylinders. Instead of the two hydraulic cylinders 70 however a correspondingly constructed hydraulic engine can also be used to operate active working assembly. Furthermore, instead of the two hydraulically working cylinders 70, one single working cylinder can be provided for the movements of extended arm 74, which however is then moved back and forth with slightly lesser savings of volume.

On the rod side, the two hydraulic cylinders 70 are connected through a connection line 76 to each other and to a fluid-carrying to a fluid control unit 78, which for example can be a controllable valve unit in the form of multi-way valves or the like. A motor-powered hydraulic pump 80 is connected to fluid control unit 78 as well as a tank conduit 82 leading to the tank 84. On the discharge side, fluid control unit 78 has another fluid-carrying connection line 86, which opens into the second connector plug 42. The first connector plug 40 of fluid chamber 20, in the embodiment shown in FIG. 1, is connected to the supply line 66, and through this supply line 66 with ambient atmosphere chamber 54. In such case, fluid chamber 20 is filled not with air, but rather with hydraulic fluid; supply line 66 is also filled with hydraulic fluid, and is connected through branch **66*a* with the hydraulic active working assembly in the form of the two hydraulic fluid-carrying cylinders 70. With the movements of pistons 12 and 14 in the direction of fluid-filled ambient atmosphere chamber 54, chamber 20 cannot then come under the pressure present in the air, and consequently cannot reach an undesired state of heating. Also, in the latter case, the fluid volumes to be controlled can be reduced or minimized for the execution of a power stroke. Supply line 66, as well as a branch 66*a*, open according to the representation of FIG. 1, into another fluid-carrying connection line 88, which is bifurcated in the direction of hydraulic cylinders 70 and is connected to hydraulic cylinders 70 on piston ends 90**.

The energy saving arrangement is now set in such a manner that an average load setting or extended arm positioning of extended arm 74 in preloaded chamber 30 generates an interior gas pressure increase to the maximum possible pressure, which corresponds to a pre-biased mechanical compression spring. If extended arm 74 should now be lifted, in other words raised upward as shown in FIG. 1, hydraulic pump 80 is connected and through fluid-control unit 78 conveys pressurized fluid through connection line 86 and second connector plug 42 into fluid chamber 22, whereby pistons 12 and 14 are moved to the right in FIG. 1. The fluid stored in fluid chamber 20 of the piston accumulator, together with the fluid out of ambient atmosphere chamber 54, is discharged through branch **66*a* or connection line 66 as well as the other connection line 88 on piston sides 90 of hydraulic cylinders 70, whereby the pressure cushion in preloaded chamber 30 supports this movement process; and the energy stored in preloaded chamber 30 is discharged through whatever fluid-carrying arrangement leads to extended arm 74. On piston rod sides 72 of working cylinders 70, the fluid volumes expelled in such a manner are relieved of pressure through connection line 76 to fluid control unit 78 and then to tank 84 through connection line 82**, without pressure.

An accumulating process to accumulate hydraulic energy in preloaded chamber 30 then occurs with lowering of arm 74, whereby the fluid stored on each piston side 90 is fed back again into fluid chamber 20 and also ambient atmosphere chamber 54, with the result that pistons 12 and 14 move to the left in FIG. 1 and the preloading in preloaded chamber 30 increases. An especially favorable lift process can be further supported with movement of extended arm 74 around a midpoint. Insofar as extended arm 74 is to move with working machines, the gas supply arrangement 62 in the form of the nitrogen accumulator can be deleted. If, however, because it has to do with extended arm 74 moving around a lifting platform, the force constants or elasticity constants are lowered, in order to attain a uniform energy discharge over longer movement paths, the chamber volume of preloaded chamber 30 is increased through the connection of accumulator 62. Furthermore, by switching fluid control unit 78, the rod-side of each hydraulic cylinder 70 is filled under pressure through hydraulic pump 80, which simplifies the lowering procedure as well as the increase of gas pressure in preloaded chamber 30.

Another piston accumulator is shown in FIG. 3, which, similar to the piston accumulator embodiment of FIG. 2, is suitable for this energy-saving purpose, in which an energy saving device as shown in the diagram of FIG. 1 can be used the same structural parts of the piston accumulator as in FIG.

2 are indicated with the same references but increased by 100, when they are arranged according the representation of FIG. 2. The statements made in reference to the embodiment of FIG. 2 consequently correspond to the embodiment of the piston accumulator of FIG. 3. In the following, only features of the FIG. 3 embodiment which differ essentially from the embodiment as described in FIG. 2 are described.

In the embodiment of FIG. 3, the sealing walls 126 and 128 are constructed of one piece and are screwed together on the interior of the housing tube 136. Connector plugs 140 and 142 open in one direction, in other words in the downward direction, as shown in FIG. 3 out of the interior of housing 110. The two-part partition wall 118 in turn can adapt to a hollow cylindrical central member 134 and they engage mutually one into the other, whereby the tight connection is realized by a screw connection 192, engaging through flange-like extensions of the central member of the two-part partition wall. Moreover, the cylindrical middle cutouts 156 in pistons 112 and 114 are arranged in coaxial alignment with the longitudinal axis 138, as well as facing toward one another. Consequently, an expansion of the volume of fluid found in chambers 120 and 122 takes place.

The two embodiments of a piston accumulator as shown both in FIG. 2 and FIG. 3 show a partial arrangement arranged essentially symmetrical to a middle axis and to its longitudinal axis 38 or 138. This allows for cost savings in the use of a plurality of piston accumulators using lower and cost standard structural parts in their manufacture.

While various embodiments have been chosen to illustrate the invention, it will be understood by those skilled in the art that various changes and modifications can be made therein without departing from the scope of the invention as defined in the appended claims.

What is claimed is

1. A device for saving energy, comprising:

a hydraulically operable working assembly;

a hydraulic pump;

a position accumulator including a housing in which first and second longitudinally displaceable pistons are arranged and are connected facing one another by a coupling part, said coupling part being guided for longitudinal displacement in a partition wall of said housing, said housing and said pistons defining first and second fluid chambers therebetween, said first piston at least partially limiting a preloaded chamber with a predeterminable internal gas pressure on one side of said first piston and with said first fluid chamber being on an opposite side of said first piston, said first fluid chamber being provided with a filler medium and being connected to said working assembly, said second piston at least partially limiting an ambient atmosphere chamber of said piston accumulator, said ambient atmosphere chamber being connected in fluid communication to said working assembly and to said first fluid chamber; and a reversible fluid control unit connecting said second fluid chamber to said hydraulic pump.

2. A device according to claim 1 wherein said preloaded chamber is limited by a stationary sealing wall of said housing, said sealing wall having a connector plug for coupling a gas supply arrangement to said sealing wall.

3. A device according to claim 2 wherein said gas supply arrangement is a nitrogen reservoir.

4. A device according to claim 1 wherein first and second connection plugs on opposite sides of said partition wall open into said first and second fluid chambers, respectively.

5. A device according to claim 1 wherein said working assembly comprises at least one hydraulically operable working cylinder having a rod side connected to said fluid control unit and a piston side connected to said ambient atmosphere chamber.

6. A device according to claim 5 wherein said piston side to connected to said first fluid chamber.

7. A device according to claim 1 wherein said coupling part comprises a coupling rod having ends securely connected with said first and second pistons, respectively.

8. A device according to claim 1 wherein said coupling part is in sealed contact with said partition wall, said partition wall comprising a central support connected to housing tubes of said housing on both sides of said central support, said housing tubes longitudinally guiding said pistons.

9. A device according to claim 1 wherein said piston accumulator is constructed essentially symmetrical to a middle axis aligned transverse of a longitudinal axis of said piston accumulator and to said longitudinal axis.

* * * * *